US005437391A

United States Patent [19]

Landers et al.

[11] Patent Number: 5,437,391

[45] Date of Patent: Aug. 1, 1995

[54] ICE DISPENSER CONTROLLING ROCKING CHUTE

[75] Inventors: Jerry L. Landers, Sellersburg, Ind.; Thomas J. Pfiefer; Harvey R. Brandon, both of Louisville, Ky.

[73] Assignee: SerVend International, Inc., Sellersburg, Ind.

[21] Appl. No.: 169,386

[22] Filed: Dec. 20, 1993

[51] Int. Cl.[6] ..... B67D 3/00

[52] U.S. Cl. ..... 222/1; 222/146.6; 222/153.14; 222/461; 222/505; 141/362; 62/344

[58] Field of Search ..... 62/344, 377; 272/146.6–505, 153, 460, 461; 141/360, 361, 362

[56] References Cited

U.S. PATENT DOCUMENTS

| | | | |
|---|---|---|---|
| 3,537,273 | 11/1970 | Alvarez | 62/377 X |
| 4,090,641 | 5/1978 | Lindenschmidt | 62/344 X |
| 4,102,660 | 7/1978 | Beckett et al. | 222/461 X |
| 4,227,383 | 10/1980 | Horvay | 62/344 |
| 4,248,276 | 2/1981 | Gosnell | 141/362 X |
| 4,555,049 | 11/1985 | Mawby et al. | 222/146.6 X |
| 4,610,378 | 9/1986 | Grossi | 222/505 X |
| 4,679,715 | 7/1987 | Hovinga | 222/146.6 X |
| 4,807,711 | 12/1989 | O'Brien et al. | 222/504 X |
| 4,901,396 | 2/1990 | Tatematsu et al. | 62/344 X |
| 5,029,737 | 7/1991 | Yamamoto | 222/146.6 X |
| 5,180,081 | 1/1993 | McCann | 222/23 |

*Primary Examiner*—Andres Kashnikow
*Assistant Examiner*—Lisa Douglas
*Attorney, Agent, or Firm*—James Creighton Wray

[57] ABSTRACT

A pivoted ice dispensing chute is pushed rearward to lift a door lock, lift a door and contact a microswitch for starting an ice dispensing mechanism. Release of the chute allows the chute to swing forward, opening the microswitch and stopping the ice dispensing mechanism, and allowing the door to drop downward and the lock to drop downward below the door. In its downward position, the door is adjacent the back of the chute to prevent lifting of the door and unwanted movement of ice through the chute. The chute is generally rectangular in planform, with a sloping back, sides and a rounded front. The top of the chute and the bottom of the chute are open. The back of the chute has a rib with a lateral extension which operates the microswitch. The rib lifts the door lock and lifts the door. A push plate bracket is relocatable on the chute to rest on the front of the chute for pushing with a hand and to be positioned beneath a lower end of the back of the chute to be pushed with a cup or with a hand that holds a cup. The chute, the door, the lock and the microswitch are mounted on two brackets which are mounted on a face of an ice dispenser near an ice dispensing opening. The chute is supported on pins at the distal ends of the bracket, which extend through sides of the chute near the front.

20 Claims, 2 Drawing Sheets

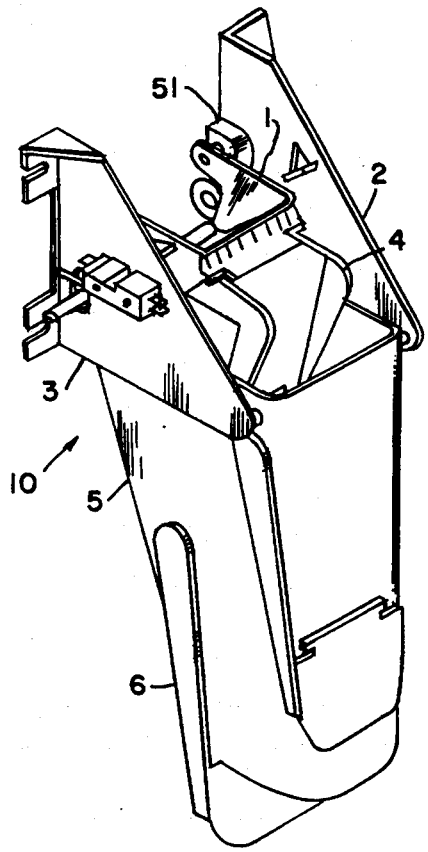
FIG. 2
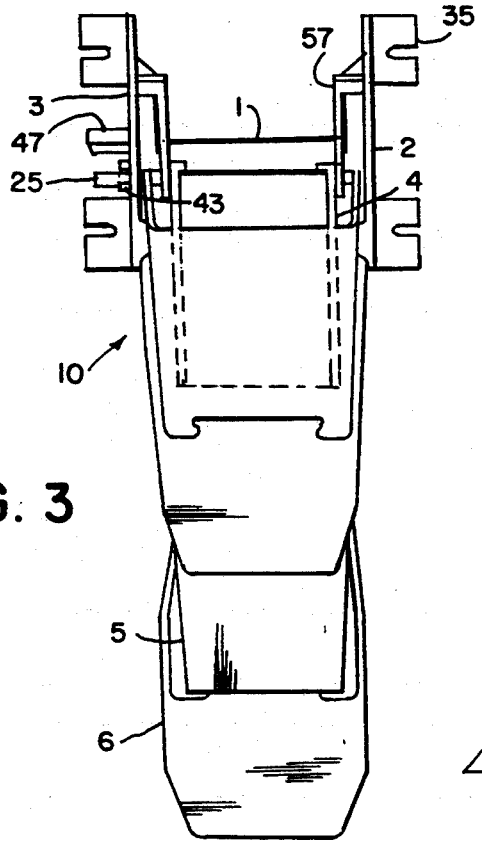
FIG. 3
FIG. 4
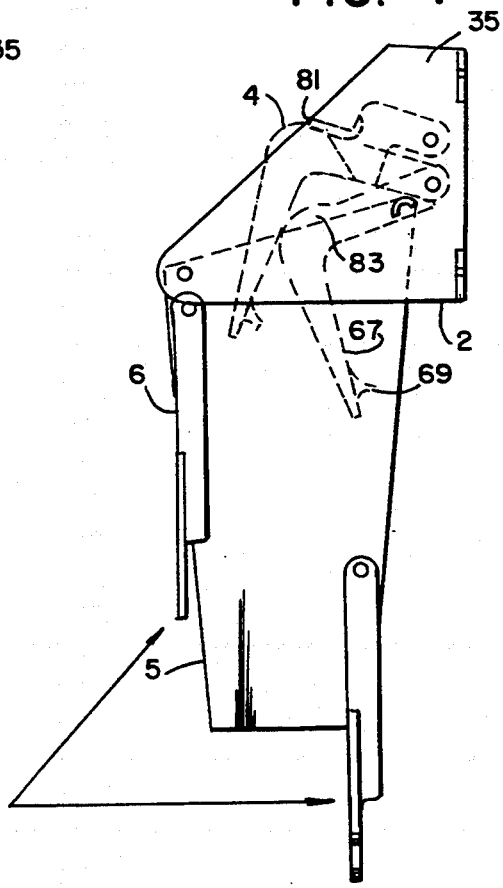

ICE DISPENSER CONTROLLING ROCKING CHUTE

BACKGROUND OF THE INVENTION

An ice dispenser has a storage hopper, a drive train system for delivering the ice and door mechanism for opening and permitting flow of ice and closing for stopping the flow of ice when the customers have received the quantity they expect. Through the history of ice and ice beverage dispensers, the door mechanism has been an area of concern. These concerns range from service issues caused by the number of cycles and large amounts of development time needed to create long lasting, service free mechanisms.

Typically door mechanisms on more widely accepted dispensers are electromechanical devices. A solenoid is energized, and linkage to a door causes the door to open or close. The life of the electric solenoid, the bearings of the linkage device and the number of parts which require time and skills and which introduce potentials for error during the assembly process have always been main concerns of the ice dispenser door mechanisms.

SUMMARY OF THE INVENTION

The present invention is a mechanical system made up of five parts, three of which move. The chute is totally injection molded out of materials that will withstand the high rate of usage.

By only having five parts, one of the main concerns, the number of assembly activities to create the unit within the manufacturing process, has been addressed. The process has been simplified by having different size bearing surfaces, so that the parts will only mate in the correct manner. The parts are also totally injection molded, which creates the necessary tolerances for a proper fit.

The bearing surfaces are injection molded into the parts, creating proper matching of the materials and tolerances for long lasting service lift. Since only three parts move within the total mechanism, the concern about bearings and linkage deterioration has been greatly reduced.

Since the chute is totally mechanical, the major concern of the electric solenoid burning out has totally been eliminated. By rotating the chute, either by pushing on the push lever with a cup or by pushing on the elevated surface resembling a push button, the chute is rotated towards the rear of the dispenser. As the chute rotates towards the rear, it also has a lifting motion which first moves the locking device that has the capability of locking the door in place and then elevates the door so that ice can freely flow from the dispenser. When a customer has received the volume of ice that is preferred, removal of pressure from the chute allows it to rotate (due to gravity) back to neutral position. When the chute reaches the neutral position, it reverses the lifting action on the door and locking mechanism, and they return back to a position which stops the flow of ice.

The locking device is a new concept for ice dispensers. Periodic ice agitation is required to prevent bridging and jamming of ice and to maintain the ice within the hopper in a free flowing condition. During agitation cycles of ice dispensers, the door on past units has opened and allowed ice to be dispensed. The locking device incorporated in the rocking chute wedges behind the door to eliminate the movement of the door which would allow ice to spill into the drain pan.

The mounting brackets for the door mechanism mount onto the front of the ice dispenser and supply the hinging points for the chute, door and locking device. One bracket has a self-locking mechanism for holding a microswitch which is activated by the chute movement. The microswitch electrically activates the drive train system which causes the ice to be dispensed through the door area.

A pivoted ice dispensing chute is pushed rearward to lift a door lock, lift a door and contact a microswitch for starting an ice dispensing mechanism. Release of the chute allows the chute to swing forward, opening the microswitch and stopping the ice dispensing mechanism, and allowing the door to drop downward and the lock to drop downward against the door. In its downward position, the door is adjacent the back of the chute to prevent unwanted movement of ice through the chute. The chute is generally rectangular in planform, with a sloping back, sides and a rounded front. The top of the chute and the bottom of the chute are open.

The top of the back of the chute has a rib with a lateral extension which operates the microswitch. The rib lifts the door lock and lifts the door.

A push plate bracket is relocatable on the chute to rest on the front of the chute for pushing with a hand and to be positioned beneath a lower end of the back of the chute to be pushed with a cup or with a hand that holds a cup.

The chute, the door, the lock and the microswitch are mounted on two brackets which are mounted on a face of an ice dispenser near an ice dispensing opening. The chute is supported on pins at the distal ends of the brackets, which extend through sides of the chute near the front. Door pins extend inward from a proximal end of the bracket near the ice dispensing opening to pivot door supports. A door extends downward from distal ends of the door supports. Door lock pins extend inward above the door pins, and door lock arms are mounted on the door lock pins. Legs extend downward from the arms to contact the rib, and a lock extends forward from the arms for contacting the back of the door. The door lock is lifted a short way to clear the door before the door supports are lifted by rocking the chute backward, and the microswitch is contacted by the rib extension for starting the ice dispensing movement within the ice dispenser.

The dispensing mechanism has two mirror image triangular plates which are mounted on opposite sides of an ice dispensing opening in a storage bin. The plates have six inward extending pins mounted on three axes. Pins at outer apexes of the triangles hold a rockable chute. Lower and upper pins along vertical sides of the triangles mount an ice blocking door and a lock for the door, respectively. A microswitch is mounted on an outer side of one of the mounting plates, with an activating wand extending along an opening in the plate.

A rectangular downward convergent chute with a flat back and rounded front has openings near an upper end of its rounded front to hang the chute on the outer pins.

A gravitationally closing flat ice blocking door is mounted on L-shaped arms which are pivoted on the door pins. The arms and door fit inside the chute and trap ice against the back of the chute, or inside of the ice dispensing chute.

A U-shaped door lock fits on the upper pins and rests on top of the door mounting arms and against the back of the top of the door, preventing upward movement of the arms and door until the lock is intentionally lifted. The chute has a rib at its inner upper end, which first lifts legs of the lock to disengage the forward projecting plate from the top of the door, and then lifts the door-mounting legs to lift the door. The rib extends through the opening on one mounting plate to contact the microswitch for conveying ice to the ice dispensing opening in the bin.

A U-shaped push plate has upward extending legs with inward extending pins at upper ends. The pins connect to two alternative locations on the chute. Engaging the pins on chute openings just below the main chute pivot transfers pressure on the plate to the front of the chute. The push plate operates as a push button in that configuration. Engaging openings along the rear edge of the chute, a major portion of the blade extends below the chute, and a minor portion projects up into the chute, to transfer pressure to the chute when the blade is pushed by a cup. The location converts the chute from a push button operation to a push lever operation.

A preferred ice controlling apparatus has brackets for mounting beside an ice dispensing opening on an ice dispenser. Chute pivot pins are mounted on the brackets at positions remote from the ice dispensing opening. A chute has a front, a back, sides, an open top and an open bottom, and holes for receiving the pins for suspending and rotating the chute on the pins. A rib extends along a top of the back and extends outward from the side of the chute through an opening in the bracket for limiting outward rotation of the chute. A limit switch is connected to the bracket and has a wand for contacting the rib and starting ice dispensing operations when the wand is contacted by the rib as the chute is rocked rearward by a user.

A preferred ice controlling apparatus has door mounting pins from the brackets near the ice dispensing opening. Door supports have holes on proximal ends for receiving the door mounting pins. A door is mounted on distal ends of the door support. The door supports rest on the rib on the back of the chute for lifting the door supports and the door as the chute is rocked backwards by a customer.

The door lock pins are mounted above the door mounting pins on the bracket. Door lock arms have holes at proximal ends for mounting on the door lock pins, and door lock legs extending downward from the door lock arms for contacting the rib and lifting the door lock arms. A door lock contactor at a distal end contacts the door and preventing raising of the door until the door lock is raised by the rib and legs.

Door stops extend inward from the bracket remote from the door pins for limiting the upward raising of the door arms.

The door lock pins are mounted on the bracket above the door pins.

A push plate bracket has vertical bars with inward facing pins at upper ends, a push plate at lower ends of the bars, and openings in the sides of the chute for receiving the push plate pins.

The push plate has an upward extending portion for fitting inside the sides and adjacent the back of the chute inside the lower open end. The push plate bracket mounting holes are positioned on the sides near the back of the chute, whereby the push plate extends below the chute for pushing with a container.

Other push plate openings are mounted near an upper portion of the front of the chute. The push plate lies against a front of the chute for pushing on the front of the chute as a container is held below the chute.

The push plate is relocatable between a position on the front of the chute and a position below the chute adjacent the back of the chute.

These and further and other objects and features of the invention are apparent in the disclosure, which includes the above and ongoing written specification, with the claims and the drawings.

BRIEF DESCRIPTION OF THE DRAWINGS

FIG. 2 is an assembled perspective view of the chute controlled delivery mechanism shown in FIG. 1.

FIG. 3 is a front view of the chute controlled mechanism shown in FIGS. 1 and 2.

FIG. 4 is a side elevation showing the chute controlled mechanism.

DETAILED DESCRIPTION OF THE DRAWINGS

Figure 1:
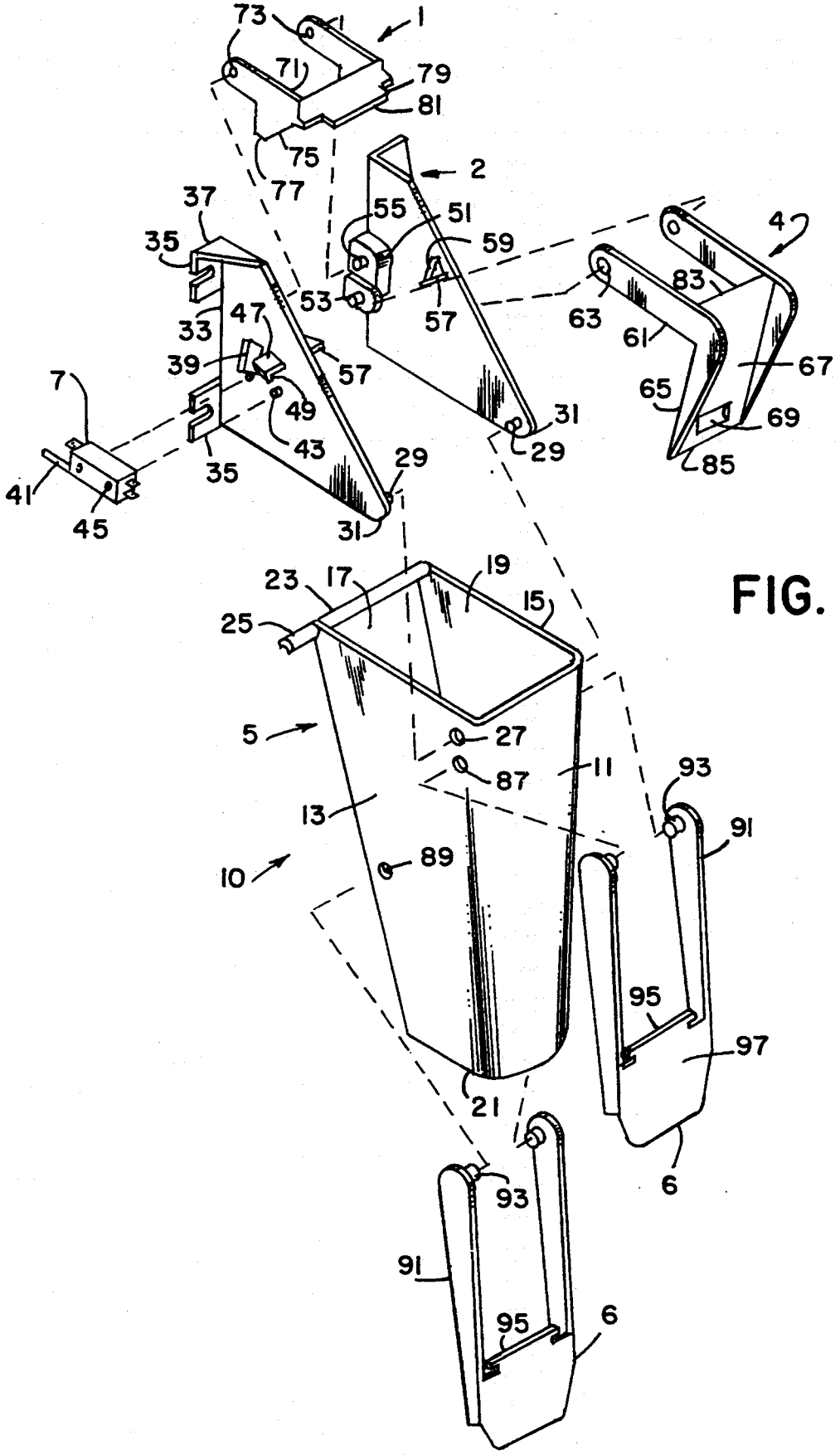
FIG. 1 is an exploded perspective view of the chute controlled ice delivery apparatus of the present invention.

Referring to the drawings, the chute controlled mechanism is generally indicated by the numeral 10. The elements of the mechanism are the door lock 1, the right mounting bracket 2, the left mounting bracket 3, the ice dispenser door 4 and the ice chute 5. A push button/push plate bracket 6 is mounted either in front of the chute or below the chute 5. A microswitch 7 is mounted on the side of the left bracket 3. The chute 5, door 4 and door lock 1 are the only moving elements. The chute 5 has a generally rectangular form, with a rounded front 11 and parallel sides 13 and 15, and a sloping back 17. A relatively large rectangular top 19 is open, and a smaller bottom opening 21 has an arched front and sides extending from the back. The roundness of the front 11 of the chute 5 increases as the front extends from the top 19 to the bottom 21. The back 17 has an enlarged rib 23 at its top, and the rib has an extension 25 which extends outward from one side.

At the top of sides 13 and 15 near the rounded front 11 are two openings 27, which receive pins 29 mounted near the distal ends 31 of the mounting brackets 2 and 3. The proximal ends 33 of the brackets have slotted mounting plates 35, which attach to an ice dispenser near an ice dispensing opening. At least one of the brackets may have a triangular support 37 to fix the rigidity of the brackets. In an alternative embodiment, the upper mounting plates 35 may extend inward for connecting to the dispenser about the ice dispensing opening.

The rib extension 25 at the top of the back of the chute extends through the opening 39 in bracket 3. Microswitch 7 with its contact wand 41 snaps on the plate and is held in fixed position by pins 43, which are received in openings 45 in the microswitch, and by a cantilevered snap 47 with a lip 49, which holds the microswitch against the mounting bracket 3.

Blocks 51 are integrally formed on the brackets near the proximal edges 33, and door mounting pins 53 and door lock mounting pins 55 extend inward from the blocks. Door travel stops 57 extend inward from the brackets 2 and 3, and triangular trusses 59 reinforce the stops 57. Door support arms 61 have openings 63 near proximal ends for mounting on the pins 53. The support arms are L-shaped and have door support portions 65 on which a flat ice-blocking door 67 is mounted. The ice blocking door may have vertical ridges for increased ice stopping strength. A rearward extension 69 is molded near a bottom end of the door. The rib 23 contacts and lifts inward ends of the door support arms 61, raising the door for ice dispensing. Stops 57 limit upward movement caused by angular momentum of the door.

To assure that the ice dispenser door 4 is not lifted unintentionally by ice, the door lock 1 is provided. The door lock 1 has arms 71 with openings 73 at proximal ends for receiving the pins 55. Legs 75 have lower edges 77, which rest upon the rib 23. A forward extending locking plate 79 has an edge 81 which abuts an inside of the upper edge 83 of the door 67 to prevent lifting of the door assembly until the door lock is first lifted. Rocking of the chute 53 rearward causes the rib 23 to first lift the door lock, and then lift the door assembly 4. At the same time, the rib extension 25 contacts the wand 41 of the microswitch 7 to energize an agitator within the ice bin and cause ice to move through the ice dispensing opening into the chute 5. When rearward moving pressure on the chute is released, the microswitch wand 41 is returned to neutral and the door drops into position with its lower edge 85 near the back of the back 17 of the chute 5. The lock 1 drops into position with its edge 81 wedged behind the upper edge 83 of the door 67. With that over-the-center locking, the door may not be raised.

The chute is equipped with a push button/push plate bracket 6, which is positioned on the chute to simulate a push button which is hand pressed, or a push plate which is cup pressed, to start the ice dispensing.

The chute 5 has paired openings 87 in the sides 13 and 15 near the openings 27, and paired openings 89 midway along the rear of the sides 13 and 15 to hold the push button/push plate bracket 6. It is intended that a single bracket 6 be used, but the chute may be provided with two brackets. The push button/push plate bracket 6 has two vertically extending arms 91 with inward extending pins 93, which fit either in the openings 87 or the openings 89. A plate 97 extends across the lower ends of the arm, and the plate has an upward extension 95 which fits inside the lower opening 21 of the chute 5 and rests against a lower portion of the back 17. Pushing rearward on the plate 97 lifts the lock and then the door, and causes the microswitch to begin ice dispensing operations.

The pins may be interchangeably placed on the moving elements or on the relatively fixed elements, with openings on the cooperating elements for receiving the pins. For example, the openings 27, 87 and 89 and in chute 5 may be replaced with pins, and the pins 29 and 93 may be replaced with openings. The same is true with pins 53 and openings 63, and pins 55 and openings 73.

The chute operates as a lever or a lifter for lifting the lock then the door, and contacting the microswitch.

While the invention has been described with reference to specific embodiments, modifications and variations of the invention may be constructed without departing from the scope of the invention, which is defined in the following claims.

We claim:

1. Ice controlling apparatus comprising brackets for mounting beside an ice dispensing opening on an ice dispenser, chute pivot pins mounted on the brackets at positions remote from the ice dispensing opening, a chute having a front, a back, sides, an open top and an open bottom, and having holes for receiving the pins for suspending and rotating the chute on the pins, an opening in one of the brackets, a rib extending along a top of the back and extending outward from one side of the chute through the opening in the brackets for limiting rearward rotation of the chute, and a limit switch connected to the brackets and having a wand for contacting the rib and starting ice dispensing operations when the wand is contacted by the rib as the chute is rocked rearward by a user.

2. The apparatus of claim 1, further comprising door mounting pins extending inward from the brackets near the ice dispensing opening, door supports having holes on proximal ends for receiving the door mounting pins, and a door mounted on distal ends of the door supports, the door supports resting on the rib on the back of the chute for lifting the door supports and the door as the chute is rocked rearward by a user.

3. The apparatus of claim 2, further comprising door lock pins mounted on the brackets and door lock arms having holes at proximal ends for mounting on the door lock pins, and having door lock legs extending downward from the door lock arms for contacting the rib and lifting the door lock arms, whereby the lock arms are lifted in response to the chute being rocked rearward, and having a door lock contactor at a distal end for contacting the door and preventing raising of the door until the door lock is raised by the rib and legs.

4. The apparatus of claim 2, further comprising door stops extending inward from the brackets remote from the door mounting pins for limiting the upward raising of the door supports.

5. The apparatus of claim 3, wherein the door lock pins are mounted on the bracket above the door pins.

6. The apparatus of claim 1, further comprising a push plate bracket having vertical bars with inward facing pins at upper ends, and having a push plate at lower ends of the bars, and openings in the sides of the chute for receiving the push plate pins.

7. The apparatus of claim 6, wherein the push plate has an upward extending portion for fitting inside the sides and adjacent the back of the chute inside the open bottom, and wherein the push plate bracket openings are positioned on the sides near the back of the chute, whereby the push plate extends below the chute for pushing with a container.

8. The apparatus of claim 6, wherein the push plate bracket openings are mounted near an upper portion of the front of the chute, and wherein the push plate lies against the front of the chute for pushing on the front of the chute as a container is held below the chute.

9. The apparatus of claim 8, wherein the push plate is relocatable between the position on the front of the chute and a position below the chute adjacent the back of the chute.

10. The apparatus of claim 1, further comprising door mounting pins extending inward from the brackets near the ice dispensing opening, door supports having holes on proximal ends for receiving the door mounting pins, and a door mounted on distal ends of the door supports, the door supports resting on the rib on the back of the chute for lifting the door supports and the door as the chute is rocked rearward by a user, door lock pins mounted above the door mounting pins on the brackets and door lock arms having holes at proximal ends for mounting on the door lock pins, and having door lock legs extending downward from the door lock arms for contacting the ribs and lifting the door lock arms, whereby the lock arms are lifted in response to the chute being rocked rearward, and having a door lock contactor at a distal end for contacting the door and preventing raising of the door until the door lock is raised by the rib and legs, and door stops extending inward from the brackets remote from the door mounting pins for limiting the upward raising of the door supports.

11. The apparatus of claim 1, further comprising a push plate bracket having vertical bars with inward facing pins at upper ends, having a push plate at lower ends of the bars, and first and second sets of push plate mounting openings in the sides of the chute for receiving the push plate pins, wherein the push plate has an upward extending portion for fitting inside the sides and adjacent the back of the chute inside the open bottom, wherein the first set of push plate mounting openings is positioned on the sides near the back of the chute, whereby the push plate may extend below the chute for pushing with a container, and wherein the second set of push plate mounting openings is mounted near an upper portion of the front of the chute, wherein the push plate may lie against the front of the chute for pushing on the front of the chute while a container is held below the chute, and wherein the push plate is relocatable between the position on the front of the chute and the position below the chute adjacent the back of the chute.

12. Ice dispensing apparatus comprising brackets for mounting near an ice dispensing opening in an ice dispenser, a door hinged on the brackets for opening and closing the door, a door lock hinged on the brackets for locking the door in a closed position, and a lifter supported on the brackets for lifting the door lock and then lifting the door to an open position.

13. The apparatus of claim 12, further comprising a microswitch connected one of the brackets for contact by the lifter to begin ice movement.

14. The apparatus of claim 13, wherein the lifter is a lever supported on the brackets by pivots.

15. The apparatus of claim 13, wherein the lifter is a movable ice directing chute which is pivoted at an upper front portion and which lifts the door lock and the door with an upper back portion of the chute.

16. The method of dispensing ice, comprising pushing a pivoted ice dispensing chute rearward, lifting a door lock, lifting a door and contacting a microswitch with the chute for starting an ice dispensing mechanism, releasing the chute, allowing the chute to swing forward, releasing the microswitch and stopping the ice dispensing mechanism, allowing the door to drop downward and allowing the lock to drop downward against the door, and holding the door adjacent a back of the chute for preventing unwanted movement of ice through the chute.

17. The method of claim 16, wherein the lifting of the lock and the door comprises lifting the lock and the door with a rib on a top of the back of the chute.

18. The method of claim 17, wherein a lateral extension on the rib operates the microswitch.

19. The method of claim 16, wherein the pushing of the chute comprises pushing a plate relocatable on the chute to rest on a front of the chute for pushing with a hand or to hang beneath a lower end of the back of the chute to be pushed with a cup or with a hand that holds a cup.

20. The method of claim 16, further comprising mounting the chute, the door, the lock and the microswitch on two brackets which are mounted on an ice dispenser near an ice dispensing opening, supporting the chute on pins at the distal ends of the brackets, which extend through sides of the chute near a front of the chute, supporting door supports on door pins extending inward from a proximal end of the brackets near the ice dispensing opening, extending the door downward from distal ends of the door supports, supporting the door lock on door lock pins extending inward from the brackets above the door pins, and wherein the lifting comprises lifting the door lock a short way to clear the door before lifting the door supports by rocking the chute backward, and then lifting the door and the door lock with the chute, and wherein the microswitch is contacted by an extension on the chute for starting the ice dispensing movement within the ice dispenser.

* * * * *